US012742271B2

(12) United States Patent
Uehara et al.

(10) Patent No.: US 12,742,271 B2
(45) Date of Patent: Sep. 22, 2026

(54) MESH WARP KNITTED FABRIC AND TEXTILE PRODUCT

(71) Applicant: Violetta Co., Ltd., Osaka (JP)

(72) Inventors: Kenji Uehara, Osaka (JP); Miyako Marumo, Osaka (JP)

(73) Assignee: VIOLETTA CO., LTD., Osaka (JP)

( * ) Notice: Subject to any disclaimer, the term of this patent is extended or adjusted under 35 U.S.C. 154(b) by 0 days.

(21) Appl. No.: 19/102,657

(22) PCT Filed: Jul. 2, 2024

(86) PCT No.: PCT/JP2024/023878
§ 371 (c)(1),
(2) Date: Feb. 10, 2025

(87) PCT Pub. No.: WO2025/146730
PCT Pub. Date: Jul. 10, 2025

(65) Prior Publication Data

US 2026/0009171 A1 Jan. 8, 2026

(30) Foreign Application Priority Data

Jan. 5, 2024 (JP) ..... 2024-000685

(51) Int. Cl.
*D04B 21/12* (2006.01)
*D03D 13/00* (2006.01)
(Continued)

(52) U.S. Cl.
CPC ..... *D04B 21/12* (2013.01); *D03D 13/004* (2013.01); *D04B 21/06* (2013.01); *D04B 27/32* (2013.01);
(Continued)

(58) Field of Classification Search
CPC ..... D04B 27/32; D04B 21/06; D04B 21/12; D03D 13/004; D10B 2501/02;
(Continued)

(56) References Cited

U.S. PATENT DOCUMENTS 3,834,193 A * 9/1974 Wilkens ..... D04B 27/32 66/84 R
3,845,641 A * 11/1974 Waller ..... D04B 23/08 26/9
(Continued)

FOREIGN PATENT DOCUMENTS

JP 7-70893 3/1995
JP 2657200 9/1997
(Continued)

OTHER PUBLICATIONS

JP-2019135336-A English Translation (Year: 2019).*
(Continued)

*Primary Examiner* — Alissa J Tompkins
*Assistant Examiner* — Dakota Marin
(74) *Attorney, Agent, or Firm* — Wenderoth, Lind & Ponack, L.L.P.

(57) ABSTRACT

A warp knitted fabric is a mesh warp knitted fabric knitted with non-elastic yarns and elastic yarns and at least partially including a mesh texture. In the mesh texture, a plurality of non-elastic yarns are knitted in conformance to a pair of repeating patterns opposed to each other, and a plurality of elastic yarns are knitted in conformance to the pair of repeating patterns to be overlapped on the plurality of non-elastic yarns. The plurality of non-elastic yarns conforming to one of the pair of repeating patterns, the elastic yarns overlapped on the plurality of non-elastic yarns conforming to the one of the pair of repeating patterns, and the plurality of elastic yarns conforming to the other of the pair
(Continued)

of repeating patterns include a non-threaded position, and the plurality of non-elastic yarns conforming to the other of the pair of repeating patterns do not include a non-threaded position.

14 Claims, 7 Drawing Sheets

(51) Int. Cl.
*D04B 21/06* (2006.01)
*D04B 27/32* (2006.01)

(52) U.S. Cl.
CPC ..... *D10B 2331/02* (2013.01); *D10B 2331/06* (2013.01); *D10B 2331/12* (2013.01); *D10B 2401/02* (2013.01); *D10B 2501/02* (2013.01)

(58) Field of Classification Search
CPC ..... D10B 2401/02; D10B 2331/12; D10B 2331/06; D10B 2331/02
USPC ..... 66/207, 195
See application file for complete search history.

(56) References Cited

U.S. PATENT DOCUMENTS 3,895,489 A * 7/1975 Waller ..... D04B 23/08 66/203
3,910,075 A * 10/1975 Holliday ..... D04B 21/18 66/190
3,922,888 A * 12/1975 Patterson ..... D04B 21/18 D5/47
3,931,721 A * 1/1976 Adamson ..... D04B 21/18 66/195
4,753,088 A * 6/1988 Harrison ..... D04B 21/12 2/48
4,786,549 A * 11/1988 Richards ..... D04B 21/18 156/308.2
5,029,457 A * 7/1991 Gajar ..... D04B 21/06 66/195
5,150,587 A * 9/1992 Bergmann ..... D04B 27/32 66/84 R
5,385,036 A * 1/1995 Spillane ..... A43B 1/04 66/196
6,477,865 B1 * 11/2002 Matsumoto ..... D04B 21/10 66/196
6,745,601 B2 * 6/2004 Pierelli ..... D04B 21/12 66/195
6,837,078 B1 * 1/2005 Rock ..... D04B 21/04 66/195
6,845,639 B1 * 1/2005 Hajek ..... A44B 18/0034 66/195
7,051,556 B2 * 5/2006 Oya ..... D04B 21/18 66/172 E
7,235,504 B2 * 6/2007 Shirasaki ..... A47C 31/006 66/196
7,395,681 B2 * 7/2008 Oya ..... D04B 21/207 66/172 E
7,757,519 B2 * 7/2010 Lonati ..... D04B 27/32 66/205
8,418,508 B2 * 4/2013 Lecuivre ..... D04B 21/10 66/170
9,279,201 B2 * 3/2016 Akita ..... D04B 21/18
10,829,878 B2 * 11/2020 Hamada ..... D04B 21/14
2003/0106346 A1 * 6/2003 Matsumoto ..... D04B 21/10 66/195
2004/0000173 A1 * 1/2004 Keller ..... D04B 21/16 66/170
2004/0168479 A1 * 9/2004 McMurray ..... D04B 1/16 66/202
2009/0126411 A1 * 5/2009 Callaway ..... D04B 21/06 66/192
2010/0055381 A1 * 3/2010 Yamaguchi ..... D04B 21/02 428/91
2012/0177904 A1 * 7/2012 Gehring, Jr. ..... D04B 21/10 428/220
2012/0297840 A1 * 11/2012 Yeung ..... D04B 21/18 66/195
2013/0298612 A1 * 11/2013 Yuikawa ..... D04B 21/20 66/204
2015/0299915 A1 * 10/2015 Meneghin ..... A61F 2/0063 28/165
2024/0352634 A1 * 10/2024 Ota ..... D04B 21/08

FOREIGN PATENT DOCUMENTS

JP 2013-155463 8/2013
JP 2013155463 A * 8/2013
JP 5443524 3/2014
JP 2019-116700 7/2019
JP 2019-135336 8/2019
JP 2019135336 A * 8/2019
JP 6576867 B2 * 9/2019
JP 6588075 10/2019
JP 2021-155897 10/2021

OTHER PUBLICATIONS

JP-6576867-B2 English Translation (Year: 2016).*
JP-2013155463-A English Translation (Year: 2013).*
International Search Report issued Sep. 17, 2024 in corresponding International Application No. PCT/JP2024/023878.
Decision to Grant a Patent issued Mar. 26, 2024 in corresponding Japanese Application No. 2024-000685 (with English translation).

* cited by examiner

MESH WARP KNITTED FABRIC AND TEXTILE PRODUCT

TECHNICAL FIELD

The present invention relates to a mesh warp knitted fabric and a textile product, and more particularly relates to a mesh warp knitted fabric which is less likely to cause unravelling without hem finishing and a textile product obtained by using the mesh warp knitted fabric.

BACKGROUND ART

Since a hem portion of a warp knitted fabric causes unravelling without any ingenuity, techniques for preventing the unravelling have been conventionally explored. As one of such technologies, the inventors of the present invention have proposed a warp knitted fabric which is excellent in breathability and stretchability and eliminates the need for hem finishing as well as clothes obtained by using the mesh warp knitted fabric (see Patent Literature 1).

CITATION LIST

Patent Literature

Patent Literature 1: Japanese Patent No. 5443524

SUMMARY OF INVENTION

Technical Problem

The warp knitted fabric described in Patent Literature 1 above is a non-conventional, extremely excellent warp knitted fabric. The inventors of the present invention are continually conducting studies for providing further added value to this technology while taking its advantage. As one of such efforts, the inventors of the present invention have set up challenges for preventing a warp knitted fabric from being seen through and preventing biting into (meshing with) the skin and stickiness to the skin. In other words, an object of the present invention is to provide a mesh warp knitted fabric which is excellent in breathability and stretchability and less see-through, less likely to cause biting into the skin, and less sticky to the skin without the need for hem finishing, as well as a textile product obtained by using the mesh warp knitted fabric.

Solution to Problem

The inventors of the present invention have conducted enthusiastic studies to find out that the above-described challenges can be accomplished by the following configuration and has completed the present invention.

In other words, a mesh warp knitted fabric according to the present invention is a mesh warp knitted fabric knitted with non-elastic yarns and elastic yarns and at least partially including a mesh texture. In the mesh texture, a plurality of non-elastic yarns are knitted in conformance to a pair of repeating patterns opposed to each other (regarded as an identical repeating pattern when being different only in closed lap and open lap), and a plurality of elastic yarns are knitted in conformance to the pair of repeating patterns so as to be overlapped on the plurality of non-elastic yarns. The plurality of non-elastic yarns conforming to one of the pair of repeating patterns, the elastic yarns overlapped on the plurality of non-elastic yarns conforming to the one of the pair of repeating patterns, and the plurality of elastic yarns conforming to the other of the pair of repeating patterns include a non-threaded position, and the plurality of non-elastic yarns conforming to the other of the pair of repeating patterns do not include a non-threaded position.

In the mesh warp knitted fabric according to the present invention, in knitted textures opposed to each other of the mesh warp knitted fabric, the plurality of non-elastic yarns conforming to the one of the pair of repeating patterns, the elastic yarns overlapped on the plurality of non-elastic yarns conforming to the one of the pair of repeating patterns, and the plurality of elastic yarns conforming to the other of the pair of repeating patterns are knitted while providing a non-threaded position, and the plurality of non-elastic yarns conforming to the other of the pair of repeating patterns are knitted without providing a non-threaded position as described. This can cause a sinker loop of a non-elastic yarn of the non-elastic yarns knitted in conformance to the other of the pair of repeating patterns, which is not overlapped on the elastic yarns, to traverse a through-hole of the mesh texture formed by the non-elastic yarns including the non-threaded position and conforming to the one of the pair of repeating patterns, and the elastic yarns overlapped on the non-elastic yarns including the non-threaded position and conforming to the one of the pair of repeating patterns, and the elastic yarns including the non-threaded position and conforming to the other of the pair of repeating patterns. It is therefore possible to prevent the skin from being seen through the through-hole of the mesh texture and prevent the through-hole from biting into the skin. In addition, the above knitting can create a one-way transport capability from a front-side knitted texture made of the non-elastic yarns to a rear-side knitted texture made of the elastic yarns. Thus, stickiness to the skin can be prevented by creating an undergarment with the non-elastic yarn side facing the skin.

Preferably, the pair of repeating patterns have three to twelve courses as a repeating unit and are swung to right and left in a range of three to five wales. This can ensure through-holes sufficient to prevent stickiness to the skin while restricting the number of the through-holes of the mesh texture to such a range that the skin is not excessively seen.

Particularly preferably, the pair of repeating patterns have four courses as the repeating unit and are swung to right and left in a range of three wales or have six courses as the repeating unit and are swung to right and left in a range of three or four wales. This can prevent the skin from being seen and can prevent stickiness to the skin in a better-balanced manner.

The mesh warp knitted fabric of the present invention includes a mesh warp knitted fabric in which the plurality of non-elastic yarns conforming to the one of the pair of repeating patterns are a plurality of half-set non-elastic yarns, and a mesh warp knitted fabric in which the plurality of non-elastic yarns conforming to the other of the pair of repeating patterns are composed of a combination of a plurality of half-set non-elastic yarns and a plurality of half-set or full-set non-elastic yarns that fill up a non-threaded position of the plurality of half-set non-elastic yarns. Herein, "half-set" refers to passing knitting yarns through every other one of a plurality of guides provided in line for a reed of a warp knitting machine and knitting, or refers to a knitted texture thus knitted.

Preferably, the mesh warp knitted fabric of the present invention has a grade 3 or higher one-way transport capability under AATCC (the American Association of Textile Chemists and Colorists) standard 195. This can prevent stickiness to the skin more effectively.

A textile product according to the present invention is made of the mesh warp knitted fabric according to the present invention described above.

Advantageous Effects of Invention

According to the present invention, a mesh warp knitted fabric which has sufficient breathability and stretchability and is less see-through, less likely to cause biting into the skin, and prevents stickiness to the skin by virtue of a high one-way transport capability without the need for hem finishing, as well as a textile product obtained by using the mesh warp knitted fabric can be provided.

DESCRIPTION OF EMBODIMENT

Figure 1:
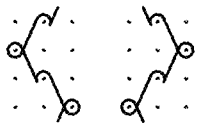
FIG. 1 is a texture diagram showing an example of a pair of repeating patterns in a warp knitted fabric of the present invention.

Hereinafter, a preferred embodiment of a mesh warp knitted fabric (hereinafter briefly expressed as a "warp knitted fabric" in some cases) and a textile product obtained by using the mesh warp knitted fabric according to the present invention will be described in detail, but the scope of the present invention is not constrained by their description. The present invention may be changed and implemented as appropriate without departing from the spirit of the present invention for intended uses other than the following illustration.

[Knitting Yarn]

The warp knitted fabric of the present invention is knitted with non-elastic yarns and elastic yarns. Conventionally known non-elastic yarns can be used for the non-elastic yarns. For example, non-elastic yarns made of a synthetic fiber such as nylon, polyester, or acrylic fiber, a recycled fiber such as rayon or acetate, a natural fiber such as cotton or silk, or the like can be selected and used as appropriate depending on the intended use and required performance of the warp knitted fabric. The type is not particularly limited, and a draw textured yarn, a hard twist yarn, an air textured yarn, a slub yarn, a mixed yarn, a composite yarn, or the like can be used. A thickness of the non-elastic yarns is not particularly limited and is 22 to 156 dtex, for example.

Conventionally known elastic yarns can also be used for the elastic yarns. For example, elastic yarns made of elastic fibers such as polyurethane fibers can be used. A covered elastic yarn obtained by covering an elastic yarn with a non-elastic yarn, a composite yarn obtained by combining a non-elastic fiber and an elastic fiber, or the like can also be used. A thickness of the elastic yarns is not particularly limited and is 22 to 470 dtex, for example.

[Mesh Texture]

A mesh texture is generally formed by repeating, on a constant repeating unit, a separated portion in which both a pair of knitting yarns opposed to each other are separated to create a through-hole. The warp knitted fabric of the present invention at least partially includes a mesh texture. The mesh texture may be formed all over the warp knitted fabric or may partially include a region (such as a jacquard pattern portion, for example) other than the mesh texture.

In the mesh texture in the present invention, a plurality of non-elastic yarns are knitted in conformance to a pair of repeating patterns opposed to each other, and a plurality of elastic yarns are knitted in conformance to a similar pair of repeating patterns so as to be overlapped on the plurality of non-elastic yarns. Note that in the present invention, the repeating patterns are regarded as an identical repeating pattern when the repeating patterns are different only in closed lap and open lap (when knitting is performed in an identical knitting direction and with an identical displacement width).

The pair of repeating patterns preferably have three to twelve courses as the repeating unit and are swung to the right and left in a range of three to five wales, and more preferably have four courses as the repeating unit and are swung to the right and left in a range of three wales or have six courses as the repeating unit and are swung to the right and left in a range of three or four wales.

<Illustration of Repeating Patterns>

Specific examples of the pair of repeating patterns for knitting the mesh texture are shown in FIGS. 1 to 7.

The example in FIG. 1 is composed of a repeating pattern of Oct. 12, 2023/21//, and a repeating pattern of 23/21/10/12//, which have four courses as the repeating unit and are swung to the right and left in the range of three wales.

Figure 2:
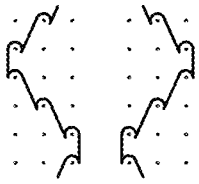
FIG. 2 is a texture diagram showing an example of the pair of repeating patterns in the warp knitted fabric of the present invention.

The example in FIG. 2 is composed of a repeating pattern of Oct. 1, 2012/23/32/21//, and a repeating pattern of 23/32/21/10/01/12//, which have six courses as the repeating unit and are swung to the right and left in the range of three wales.

Figure 3:
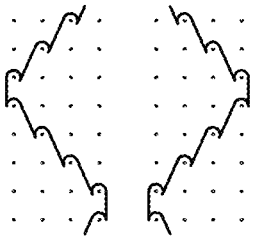
FIG. 3 is a texture diagram showing an example of the pair of repeating patterns in the warp knitted fabric of the present invention.

The example in FIG. 3 is composed of a repeating pattern of Oct. 1, 2012/23/34/43/32/21//, and a repeating pattern of 34/43/32/21/10/01/12/23//, which have eight courses as the repeating unit and are swung to the right and left in the range of four wales.

Figure 4:
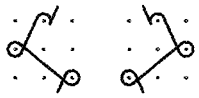
FIG. 4 is a texture diagram showing an example of the pair of repeating patterns in the warp knitted fabric of the present invention.

The example in FIG. 4 is composed of a repeating pattern of Oct. 23, 2021//, and a repeating pattern of 23/10/12//, which have three courses as the repeating unit and are swung to the right and left in the range of three wales.

Figure 5:
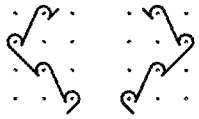
FIG. 5 is a texture diagram showing an example of the pair of repeating patterns in the warp knitted fabric of the present invention.

The example in FIG. 5 is composed of a repeating pattern of Jan. 12, 1932/21//, and a repeating pattern of 32/21/01/12//, which have four courses as the repeating unit and are swung to the right and left in the range of three wales.

Figure 6:
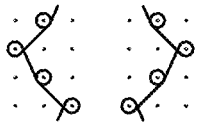
FIG. 6 is a texture diagram showing an example of the pair of repeating patterns in the warp knitted fabric of the present invention.

The example in FIG. 6 is composed of a repeating pattern of Oct. 21, 2023/12//, and a repeating pattern of 23/12/10/21//, which have four courses as the repeating unit and are swung to the right and left in the range of three wales.

Figure 7:
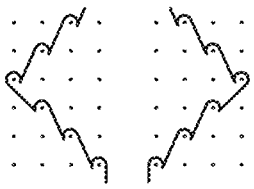
FIG. 7 is a texture diagram showing an example of the pair of repeating patterns in the warp knitted fabric of the present invention.

The example in FIG. 7 is composed of a repeating pattern of Jan. 12, 2023/43/32/21, and a repeating pattern of 43/32/21/01/12/23, which have six courses as the repeating unit and are swung to the right and left in the range of four wales.

Specific knitting examples of the mesh texture obtained by utilizing the repeating patterns illustrated in FIGS. 1 to 7 are shown in FIGS. 8 to 18. Note that in the drawings, "H" indicates half-set threading, and "F" indicates full-set threading.

Knitting Example 1

Figure 8:
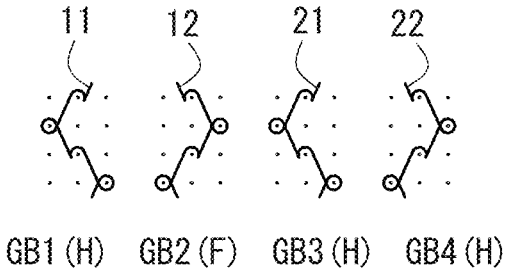
FIG. 8 is a knitted texture diagram showing an example (Knitting Example 1) of a mesh texture in the warp knitted fabric of the present invention.

A knitted texture diagram of Knitting Example 1 is shown in FIG. 8. Knitting Example 1 is composed of a non-elastic yarn knitted texture made of a non-elastic yarn 11 with which a reed GB1 is half-set threaded 1 in 1 out, a non-elastic yarn knitted texture made of a non-elastic yarn 12 with which a reed GB2 is full-set threaded, and respective elastic yarn knitted textures made of elastic yarns 21, 22 with which a reed GB3 and a reed GB4 are respectively half-set threaded 1 in 1 out.

The non-elastic yarns 11, 12 are knitted in conformance to the pair of repeating patterns shown in FIG. 1. Half-setting of the non-elastic yarn 11 allows a plurality of non-elastic yarns conforming to one of the pair of repeating patterns to include non-threaded positions 11*a* (see FIG. 19). This produces breathability by virtue of the through-holes specific to the mesh texture.

On the other hand, full-setting of the non-elastic yarn 12 allows a plurality of non-elastic yarns conforming to the other of the pair of repeating patterns not to include a non-threaded position. The elastic yarns 21, 22 are also knitted in conformance to the pair of repeating patterns shown in FIG. 1 so as to be overlapped on the non-elastic yarns 11, 12 while respectively providing non-threaded positions 21*a*, 22*a* (see FIGS. 19 and 20).

Figure 19:
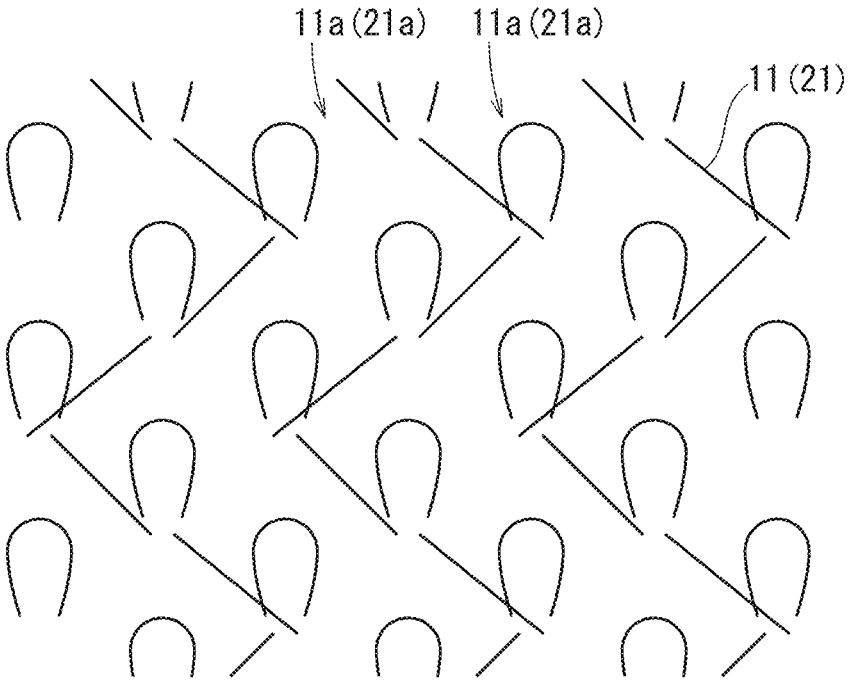
FIG. 19 is a diagram of a stitch construction made of non-elastic yarns knitted with one of the pair of repeating patterns in the mesh warp knitted fabric (Knitting Example 1) in FIG. 8 and elastic yarns overlapped on the non-elastic yarns.
Figure 20:
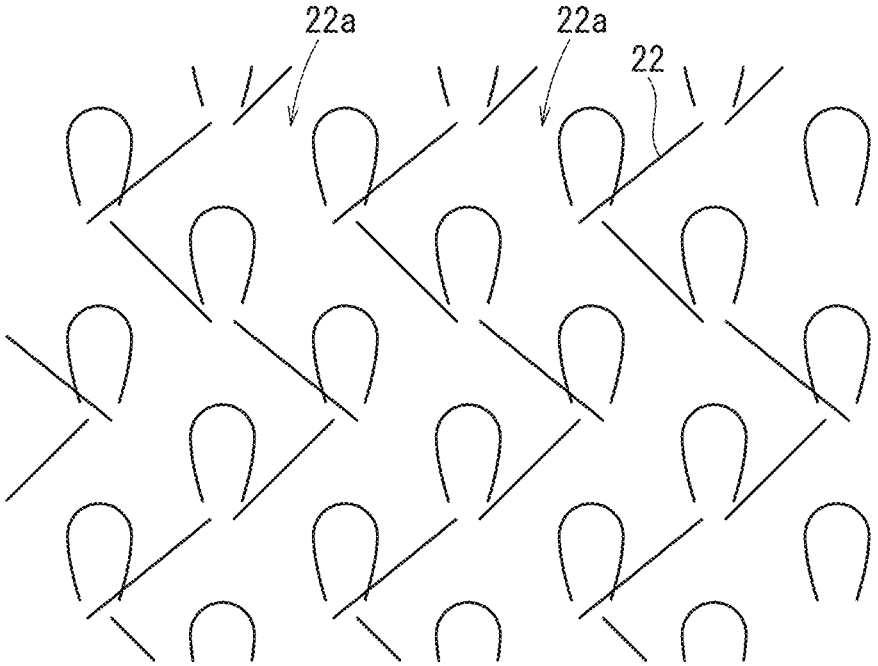
FIG. 20 is a diagram of a stitch construction made of elastic yarns knitted with the other of the pair of repeating patterns in the mesh warp knitted fabric (Knitting Example 1) in FIG. 8.
Figure 21:
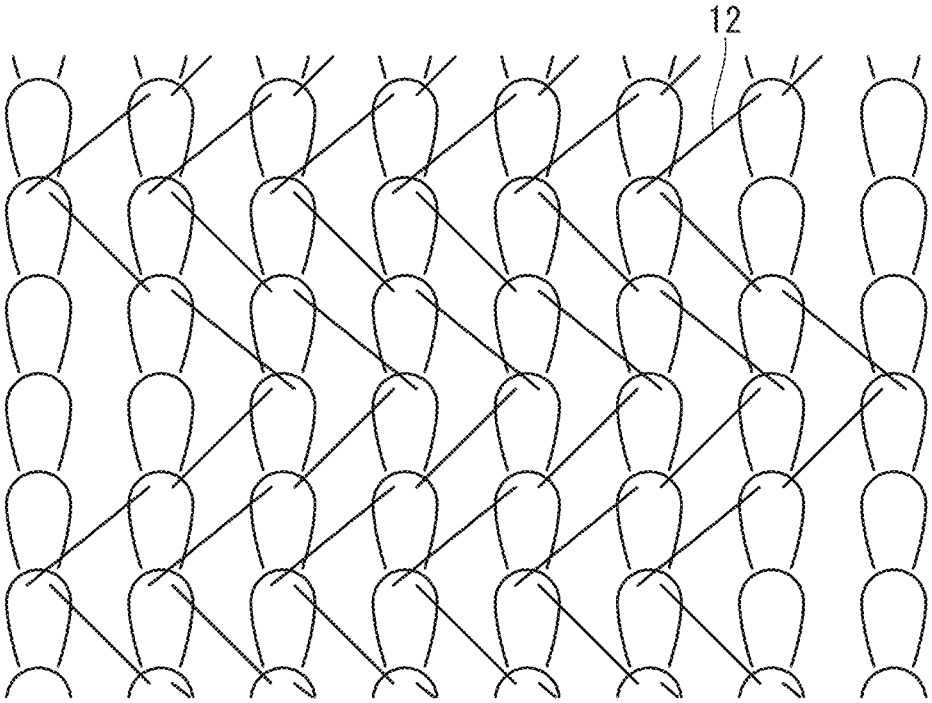
FIG. 21 is a diagram of a stitch construction made of non-elastic yarns knitted with the other of the pair of repeating patterns in the mesh warp knitted fabric (Knitting Example 1) in FIG. 8.
Figure 23:
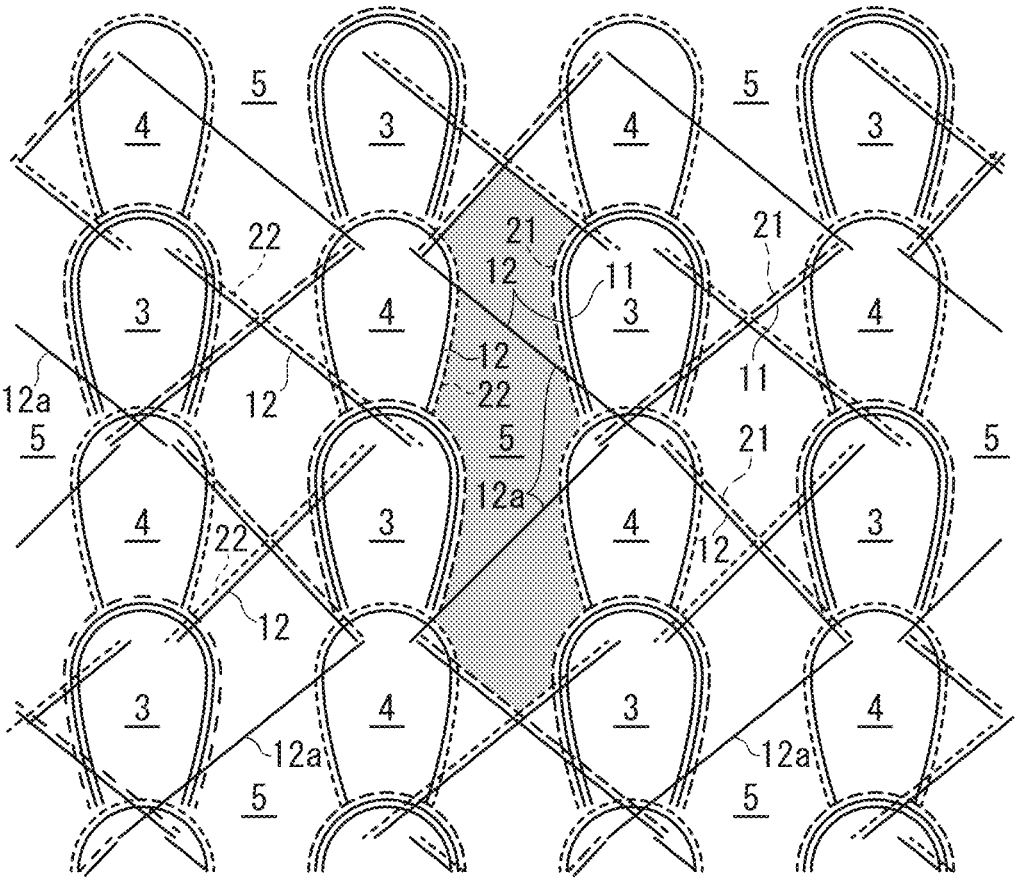
FIG. 23 is a diagram of a stitch construction showing all of knitting yarns in the mesh warp knitted fabric (Knitting Example 1) in FIG. 8 together.

FIG. 19 shows a stitch construction of the non-elastic yarn 11 and the elastic yarn 21 overlapped on the non-elastic yarn 11 in Knitting Example 1. FIG. 20 shows a stitch construction of the elastic yarn 22. FIG. 21 shows a stitch construction of the non-elastic yarn 12. FIG. 23 shows a diagram of a stitch construction showing these knitting yarns together. In FIG. 23, the non-elastic yarns 11, 12 are shown by solid lines, and the elastic yarns 21, 22 are shown by broken lines. Knitting Example 1 has a stitch construction in which a loop 3 formed by three knitting yarns of the non-elastic yarns 11, 12 and the elastic yarn 21 and a loop 4 knitted with two knitting yarns of the non-elastic yarn 12 and the elastic yarn 22 appear alternately in a course direction (an up-down direction in FIG. 19) and a wale direction (a left-right direction in FIG. 19), and through-holes 5 (one through-hole 5 is shown in gray color in FIG. 23) are provided intermittently in the course direction and the wale direction between the loop 3 and the loop 4 adjacent to each other in the wale direction. In the stitch construction of Knitting Example 1, two sinker loops 12*a* are formed by the non-elastic yarn 12 that traverses the through-hole 5. As described, since the sinker loops 12*a*, 12*a* traverse the through-hole 5, breathability can be prevented from being excessively interfered with, an anti-see-through property can be imparted, and biting into the skin can be prevented.

Figure 22:
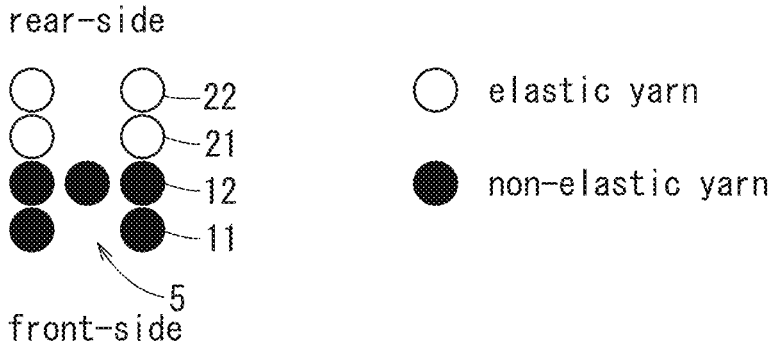
FIG. 22 is a schematic cross-sectional view of a layer construction of the mesh warp knitted fabric (Knitting Example 1) in FIG. 8.

In addition, in the warp knitted fabric of Knitting Example 1, a knitted texture of the non-elastic yarns 11, 12 is formed on the front side (on the lower side in FIG. 22) and a knitted texture of the elastic yarns 21, 22 is formed on the rear side, as shown in FIG. 22. Since the warp knitted fabric has such a layer construction, the stitch construction on the front side becomes dense, and the stitch construction on the rear side becomes sparse. It is therefore inferred that a one-way transport capability in the direction from the front side to the rear side is realized by capillary action. Moreover, the plurality of elastic yarns are knitted so as to be overlapped on the non-elastic yarns in conformance to the repeating patterns similar to the repeating patterns of the non-elastic yarns, and the non-elastic yarns and the elastic yarns are fused by what is called presetting or heat setting. Then, a warp knitted fabric which has excellent stretchability and eliminates the need for hem finishing is obtained. In the stitch construction according to Knitting Example 1, both the non-elastic yarn 11 and the non-elastic yarn 12 are fused by the elastic yarn 21 in the loop 3. Thus, a cut plane is less likely to be unraveled than in the above-described conventional mesh warp knitted fabric.

Knitting Example 2

Figure 9:
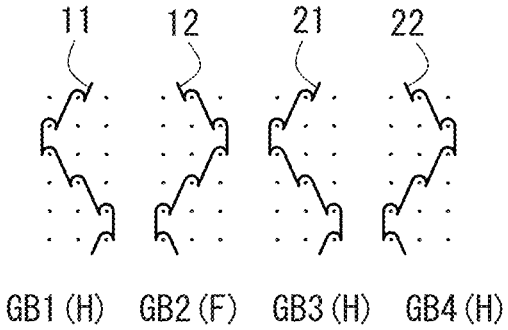
FIG. 9 is a knitted texture diagram showing an example (Knitting Example 2) of the mesh texture in the warp knitted fabric of the present invention.

A knitted texture diagram of Knitting Example 2 is shown in FIG. 9. Knitting Example 2 is the same as Knitting Example 1 except that the repeating patterns shown in FIG. 2 are employed as the pair of repeating patterns. As described, a warp knitted fabric that depends on the intended use or object can be manufactured by changing the number of courses or the swing width in the pair of repeating patterns.

Knitting Example 3

Figure 10:
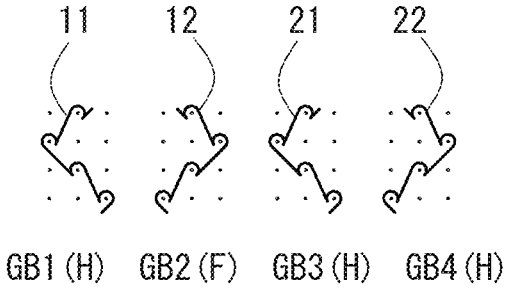
FIG. 10 is a knitted texture diagram showing an example (Knitting Example 3) of the mesh texture in the warp knitted fabric of the present invention.

A knitted texture diagram of Knitting Example 3 is shown in FIG. 10. Knitting Example 3 is the same as Knitting Example 1 except that the repeating patterns shown in FIG. 5 are employed as the pair of repeating patterns. Note that since the pair of repeating patterns shown in FIG. 1 and the pair of repeating patterns shown in FIG. 5 are knitted in the identical knitting direction and with the identical displacement width and are different only in open lap and closed lap, they are regarded as an identical repeating pattern in the present invention.

Knitting Examples 4 and 5

Figure 11:
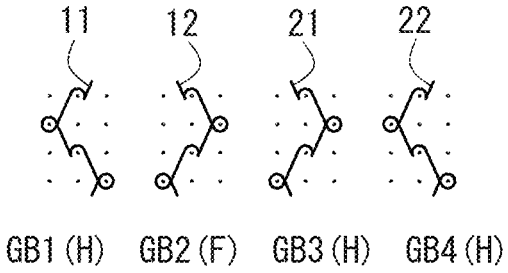
FIG. 11 is a knitted texture diagram showing an example (Knitting Example 4) of the mesh texture in the warp knitted fabric of the present invention.
Figure 12:
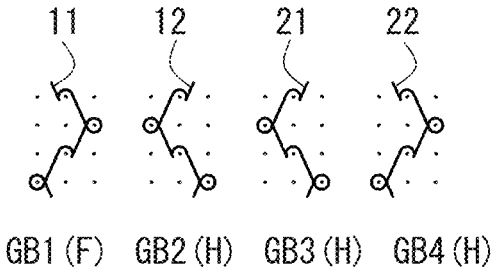
FIG. 12 is a knitted texture diagram showing an example (Knitting Example 5) of the mesh texture in the warp knitted fabric of the present invention.

Knitting texture diagrams of Knitting Examples 4 and 5 are shown in FIGS. 11 and 12. In Knitting Example 4, the respective repeating patterns knitted with the reed GB3 and the reed GB4 in Knitting Example 1 are exchanged. In Knitting Example 5, the respective repeating patterns knitted with the reed GB1 and the reed GB2 in Knitting Example 1 are exchanged. As described, in the present invention, with which reeds the respective repeating patterns are knitted is not particularly limited.

Knitting Example 6

Figure 13:
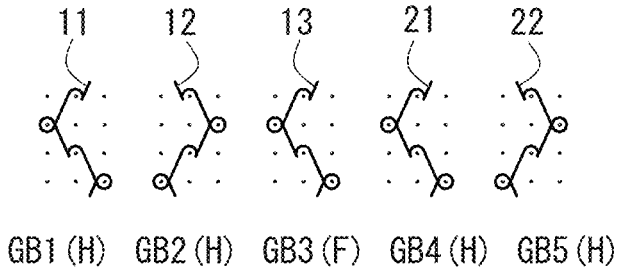
FIG. 13 is a knitted texture diagram showing an example (Knitting Example 6) of the mesh texture in the warp knitted fabric of the present invention.

A knitted texture diagram of Knitting Example 6 is shown in FIG. 13. Knitting Example 6 is composed of respective non-elastic yarn knitted textures made of the non-elastic yarns 11, 12 with which the reed GB1 and the reed GB2 are respectively half-set threaded 1 in 1 out, a non-elastic yarn knitted texture made of the non-elastic yarn 13 with which the reed GB3 is full-set threaded, and respective elastic yarn knitted textures made of the elastic yarns 21, 22 with which the reed GB4 and the reed GB5 are respectively half-set threaded 1 in 1 out.

The non-elastic yarns 11, 12 are knitted in conformance to the pair of repeating patterns shown in FIG. 1. The non-elastic yarn 13 is full-set and knitted in conformance to a repeating pattern similar to the repeating pattern of the non-elastic yarn 11 in the pair of repeating patterns shown in FIG. 1 so as to fill up the non-threaded positions of the non-elastic yarn 11.

Half-setting the non-elastic yarn 12 to arrange such that the plurality of non-elastic yarns conforming to one of the pair of repeating patterns include non-threaded positions produces breathability by virtue of the through-holes specific to the mesh texture. On the other hand, combining the non-elastic yarns 11 and 13 to arrange such that the plurality of non-elastic yarns conforming to the other of the pair of repeating patterns do not include a non-threaded position can prevent breathability from being excessively interfered with and can impart the anti-see-through property.

As described, "the plurality of non-elastic yarns conforming to the other of the pair of repeating patterns do not include a non-threaded position" in the present invention also involves a case in which a plurality of half-set non-elastic yarns (the non-elastic yarns 11 in Knitting Example 6) and a plurality of full-set non-elastic yarns (the non-elastic yarns 13 in Knitting Example 6) that fill up non-threaded positions of the plurality of half-set non-elastic yarns are combined.

Knitting Example 7

Figure 14:
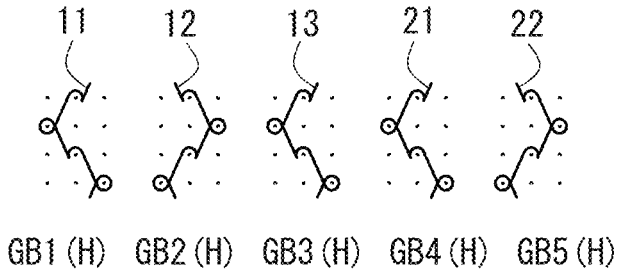
FIG. 14 is a knitted texture diagram showing an example (Knitting Example 7) of the mesh texture in the warp knitted fabric of the present invention.

A knitted texture diagram of Knitting Example 7 is shown in FIG. 14. Knitting Example 7 is the same as Knitting Example 6 except that the non-elastic yarn knitted texture made with the reed GB3 is knitted with the half-set threading non-elastic yarn 13. This non-elastic yarn 13 is incorporated into the mesh texture to fill up the non-threaded positions of the non-elastic yarn 11.

As described, "the plurality of non-elastic yarns conforming to the other of the pair of repeating patterns do not include a non-threaded position" in the present invention also involves a case in which a plurality of half-set non-elastic yarns (the non-elastic yarns 11 in Knitting Example 7) and a plurality of half-set non-elastic yarns (the non-elastic yarns 13 in Knitting Example 7) that fill up non-threaded positions of the plurality of half-set non-elastic yarns are combined.

Knitting Example 8

Figure 15:
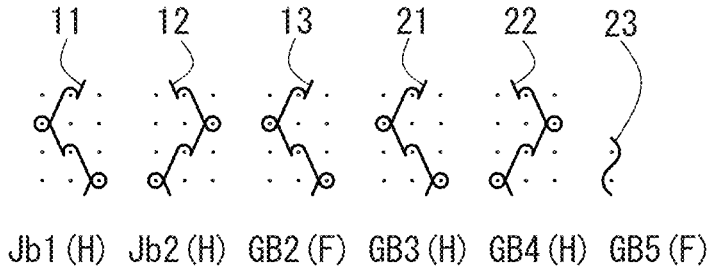
FIG. 15 is a knitted texture diagram showing an example (Knitting Example 8) of the mesh texture in the warp knitted fabric of the present invention.

A knitted texture diagram of Knitting Example 8 is shown in FIG. 15. Knitting Example 8 is a knitting example obtained by further making use of Knitting Example 6 and includes a jacquard knitted texture composed of two half-set knits. Knitting Example 8 is composed of a jacquard knitted texture made of the non-elastic yarn 11 with which a reed Jb1 is half-set threaded 1 in 1 out and the non-elastic yarn 12 with which a jacquard reed Jb2 is half-set threaded 1 in 1 out, a non-elastic yarn knitted texture made of the non-elastic yarn 13 with which the reed GB2 is full-set threaded, respective elastic yarn knitted textures made of the elastic yarns 21, 22 with which the reed GB3 and the reed GB4 are respectively half-set threaded 1 in 1 out, and an elastic yarn knitted texture made of an elastic yarn 23 with which a reed GB5 is full-set threaded.

The non-elastic yarns 11, 12 are knitted in conformance to the pair of repeating patterns shown in FIG. 1. The non-elastic yarn 13 is full-set and knitted in conformance to a repeating pattern similar to the repeating pattern of the non-elastic yarn 11 in the pair of repeating patterns shown in FIG. 1 so as to fill up the non-threaded positions of the non-elastic yarn 11.

Half-setting the non-elastic yarn 12 to arrange such that the plurality of non-elastic yarns conforming to one of the pair of repeating patterns include non-threaded positions produces breathability by virtue of the through-holes specific to the mesh texture. On the other hand, combining the non-elastic yarns 11 and 13 to arrange such that the plurality of non-elastic yarns conforming to the other of the pair of repeating patterns do not include a non-threaded position can prevent breathability from being excessively interfered with and can impart the anti-see-through property.

As described, the warp knitted fabric of the present invention can include a jacquard knitted texture by knitting the non-elastic yarns 11, 12 with the jacquard reeds Jb1, Jb2. This can add a wide variety of pattern expressions. Note that in Knitting Example 11, stretchability is improved by inserting the elastic yarn 23 with the reed GB5. It is preferable to use a thick elastic yarn (for example, 44 to 310 dtex) for the elastic yarn to be inserted. As described, in the warp knitted fabric of the present invention, a reed may be added depending on the intended use or object to add any knitted texture.

Knitting Examples 9 and 10

Figure 16:
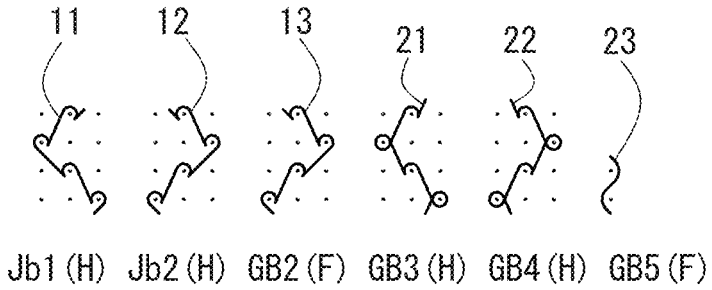
FIG. 16 is a knitted texture diagram showing an example (Knitting Example 9) of the mesh texture in the warp knitted fabric of the present invention.
Figure 17:
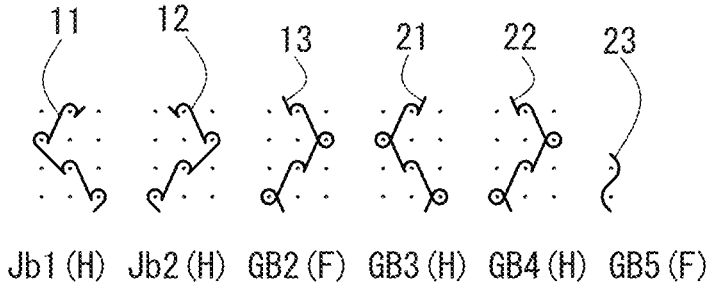
FIG. 17 is a knitted texture diagram showing an example (Knitting Example 10) of the mesh texture in the warp knitted fabric of the present invention.

Knitting texture diagrams of Knitting Examples 9 and 10 are shown in FIGS. 16 and 17. These knitting examples are different from Knitting Example 8 (FIG. 15) only in open lap and closed lap for some knitting yarns. In the present invention, repeating patterns are regarded as an identical repeating pattern when the repeating patterns are different only in open lap and closed lap. Thus, these knitting examples are also encompassed in the present invention.

[Knitting of Warp Knitted Fabric]

When the warp knitted fabric according to the present invention is knitted, a normal knitting apparatus and knitting method can be applied. A warp knitting machine is not particularly limited and, for example, a tricot knitting machine, Raschel knitting machine, or the like can be used. In a case where a jacquard knitted texture is knitted, a jacquard knitting machine including a jacquard mechanism can be used. After knitting, treatments performed for normal warp knitted fabrics, such as set treatment, scouring treatment, and dyeing treatment, can be conducted.

[Intended Uses of Warp Knitted Fabric]

The warp knitted fabric according to the present invention can be utilized for various textile products and is not particularly limited in intended use. The warp knitted fabric according to the present invention can be suitably utilized for clothes such as foundation garments, underwear, sportswear, outer clothing, bedclothing such as pillowcases and bedspreads, curtains, and the like, for example.

EXAMPLES

Although examples of the warp knitted fabric according to the present invention will be shown below, the present invention is not limited to these examples.

Example 1

A warp knitted fabric was made in conformance to Knitting Example 1 in FIG. 8 using RSE5EL (28 gauges) manufactured by Karl Mayer Co. Knitting conditions are shown in Table 1 below.

TABLE 1

| | Yarn selection (dt-F-T) | Yarn arrangement | Runner (cm/R) | Interknitting rate (%) |
|---|---|---|---|---|
| GB1 | Nylon 44dt-34-2694 | 1 in 1 out | 108.0 | 29.20 |
| GB2 | Nylon 44dt-34-2694 | ALL in | 108.0 | 58.60 |
| GB3 | Lycra 22dt-127C | 1 in 1 out | 83.0 | 6.10 |
| GB4 | Lycra 22dt-127C | 1 in 1 out | 83.0 | 6.10 |

* "Nylon 44dt-34-2694" is a non-elastic yarn manufactured by Toray Industries, Inc.
* "Lycra 22dt-127C" is an elastic yarn manufactured by Toray Opelontex Co., Ltd.

Example 2

A warp knitted fabric was made in conformance to Knitting Example 2 in FIG. 9 using RSE5EL (28 gauges) manufactured by Karl Mayer Co. Knitting conditions are shown in Table 2 below.

TABLE 2

| | Yarn selection (dt-F-T) | Yarn arrangement | Runner (cm/R) | Interknitting rate (%) |
|---|---|---|---|---|
| GB1 | W•Ny 33 d t-26-N955 | 1 in 1 out | 105.0 | 26.90 |
| GB2 | Nylon 44dt-34-2694 | ALL in | 102.0 | 59.50 |
| GB3 | Lycra 22dt-127C | 1 in 1 out | 10.8 | 6.80 |
| GB4 | Lycra 22dt-127C | 1 in 1 out | 10.8 | 6.80 |

* "W•Ny 33dt-26-N955" is a non-elastic yarn manufactured by Toray Industries, Inc.

Example 3

A warp knitted fabric was made in conformance to Knitting Example 4 in FIG. 11 using RSE5EL (28 gauges) manufactured by Karl Mayer Co. Knitting conditions are shown in Table 3 below.

TABLE 3

| | Yarn selection (dt-F-T) | Yarn arrangement | Runner (cm/R) | Interknitting rate (%) |
|---|---|---|---|---|
| GB1 | W•Ny 33 d t-26-N955 | 1 in 1 out | 108.0 | 26.60 |
| GB2 | Nylon 44dt-34-2694 | ALL in | 108.0 | 60.60 |
| GB3 | Lycra 22dt-127C | 1 in 1 out | 83.0 | 6.40 |
| GB4 | Lycra 22dt-127C | 1 in 1 out | 83.0 | 6.40 |

Reference Example 1

Figure 18:
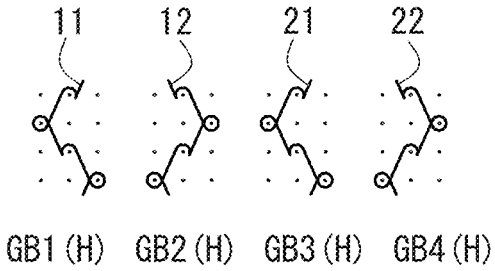
FIG. 18 is a knitted texture diagram in a warp knitted fabric of Reference Example 1.

A warp knitted fabric was made in conformance to the knitting example in FIG. 18 using RSE5EL (28 gauges) manufactured by Karl Mayer Co. Knitting conditions are shown in Table 4 below.

TABLE 4

| | Yarn selection (dt-F-T) | Yarn arrangement | Runner (cm/R) | Interknitting rate (%) |
|---|---|---|---|---|
| GB1 | Nylon 44dt-34-2694 | 1 in 1 out | 110.0 | 84.10 |
| GB2 | Nylon 44dt-34-2694 | 1 in 1 out | 110.0 | |
| GB3 | Lycra 22dt-127C | 1 in 1 out | 85.0 | 15.90 |
| GB4 | Lycra 22dt-127C | 1 in 1 out | 85.0 | |

[Performance Evaluation]

Results of testing a wetting time in a penetrated surface (front surface), an absorption rate in the penetrated surface, a one-way transport index, and drying performed for Examples 1 to 3 and Reference Example 1 using MMT (Moisture Management Tester) test equipment based on the AATCC 195 standard are shown in Table 5. KAKEN TEST CENTER General Incorporated Foundation was requested to conduct the tests. As shown in Table 5, the mesh warp knitted fabrics of Examples 1 to 3 each had sufficient wettability, absorbency, and quick-dry capability. Besides, each one-way transport index from the front side knitted with the non-elastic yarns to the rear side knitted with the elastic yarns was grade 4, which reveals that the mesh warp knitted fabrics of Examples 1 to 3 were able to effectively prevent stickiness to the skin when used as underclothes. Note that the mesh warp knitted fabric of Reference Example 1 was unmeasurable because a test solution passed through the knitted fabric.

TABLE 5

| | AATCC195 test | | | |
|---|---|---|---|---|
| | Wetting time in penetrated surface | Absorption rate in penetrated surface | One-way transport index | Drying |
| Example 1 | Grade 5 | Grade 4 | Grade 4 | 1.0/0.3 |
| Example 2 | Grade 5 | Grade 4 | Grade 4 | 0.5/0.8 |
| Example 3 | Grade 5 | Grade 4 | Grade 4 | 0.9/0.6 |
| Reference example 1 | Unmeasurable | | | |

REFERENCE SIGNS LIST

11, 12, 13 non-elastic yarn
11*a*, 21*a*, 22*a* non-threaded position
12*a* sinker loop
21, 22, 23 elastic yarn
3, 4 loop
5 through-hole
GB1, GB2, GB3, GB4, GB5 normal reed
Jb1, Jb2 jacquard reed

The invention claimed is:

1. A mesh warp knitted fabric knitted with non-elastic yarns and elastic yarns and at least partially comprising a mesh texture, wherein in the mesh texture, first and second pluralities of non-elastic yarns are respectively knitted in conformance to a pair of repeating patterns, the pair of repeating patterns being symmetrical, mirrored from each other, and opposed to each other across an axis of symmetry of the pair of repeating patterns, and first and second pluralities of elastic yarns are respectively knitted in conformance to the pair of repeating patterns so as to be respectively overlapped on the first and second pluralities of non-elastic yarns, the pair of repeating patterns are either identical, or are only different from each other with respect to whether each lap of a knitted yarn is open or closed, the first plurality of non-elastic yarns conforming to one of the pair of repeating patterns, the first plurality of elastic yarns overlapped on the first plurality of non-elastic yarns conforming to the one of the pair of repeating patterns, and the second plurality of elastic yarns conforming to the other of the pair of repeating patterns include a non-threaded position, and the second plurality of non-elastic yarns conforming to the other of the pair of repeating patterns do not include a non-threaded position.

2. The mesh warp knitted fabric according to claim 1, wherein the pair of repeating patterns have three to twelve courses as a repeating unit and are swung to right and left in a range of three to five wales.

3. The mesh warp knitted fabric according to claim 1, wherein the pair of repeating patterns have four courses as a repeating unit and are swung to right and left in a range of three wales.

4. The mesh warp knitted fabric according to claim 1, wherein the pair of repeating patterns have six courses as a repeating unit and are swung to right and left in a range of three or four wales.

5. The mesh warp knitted fabric according to claim 1, wherein the first plurality of non-elastic yarns conforming to the one of the pair of repeating patterns are a plurality of half-set non-elastic yarns.

6. The mesh warp knitted fabric according to claim 1, wherein the second plurality of non-elastic yarns conforming to the other of the pair of repeating patterns are composed of a combination of a plurality of half-set non-elastic yarns and a plurality of half-set or full-set non-elastic yarns that fill up a non-threaded position of the plurality of half-set non-elastic yarns.

7. The mesh warp knitted fabric according to claim 6, further comprising a jacquard knitted texture composed of two half-set knits, wherein one of the half-set knits that composes the jacquard knitted texture conforms to the one of the pair of repeating patterns, and the other of the half-set knits conforms to the other of the pair of repeating patterns.

8. A textile product made of the mesh warp knitted fabric according to claim 1.

9. A textile product made of the mesh warp knitted fabric according to claim 2.

10. A textile product made of the mesh warp knitted fabric according to claim 3.

11. A textile product made of the mesh warp knitted fabric according to claim 4.

12. A textile product made of the mesh warp knitted fabric according to claim 5.

13. A textile product made of the mesh warp knitted fabric according to claim 6.

14. A textile product made of the mesh warp knitted fabric according to claim 7.

* * * * *